US006066186A

United States Patent [19]

Matsumoto

[11] Patent Number: 6,066,186

[45] Date of Patent: May 23, 2000

[54] METHOD OF FORMING AND COMBUSTING WATER-IN-FUEL OIL EMULSION

[76] Inventor: Setsuo Matsumoto, 198 Regal Oak Ct., Thousand Oaks, Calif. 91320

[21] Appl. No.: 09/004,165

[22] Filed: Jan. 2, 1998

[51] Int. Cl.[7] ..... C10L 1/32

[52] U.S. Cl. ..... 44/301; 516/6; 516/21

[58] Field of Search ..... 44/301; 516/6, 516/21

[56] References Cited

U.S. PATENT DOCUMENTS

| | | | |
|---|---|---|---|
| 4,394,131 | 7/1983 | Marro | 516/21 |
| 4,495,086 | 1/1985 | Hiroshima et al. | 516/21 |
| 5,834,539 | 11/1998 | Krivohlavek | 524/60 |

FOREIGN PATENT DOCUMENTS 9314630 8/1993 WIPO .

OTHER PUBLICATIONS

Andrusyak, A.N., Azerb. Neft. Khoz. (1981), (5), 41–3, 59.

*Primary Examiner*—Jacqueline V. Howard
*Assistant Examiner*—Cephia D. Toomer
*Attorney, Agent, or Firm*—Muramatsu & Associates

[57] ABSTRACT

A method of forming particles of capsularized emulsion fuel with high combustion efficiency and low pollutant emission. The method includes the steps of preparing an emulsion fuel oil and disperse phase of water generally uniformly distributed and suspended in the dispersion medium of oil, and spraying the emulsion fuel oil into minute particles so that substantially each of the particles has a core encapsulated by fuel oil. The emulsion fuel oil includes an emulsifying additive solution essentially consisting of NaOH, $CaCl_2$ and water in a weight ratio ranging from about 10:10:100 to about 50:50:100 and a mixture of water and oil. The mixture of water and oil has an exemplified weight ratio ranging from about 5:95 to about 30:70. In the emulsion fuel oil, an example of a weight ratio of the mixture of oil and water and the emulsifying additive solution ranges from about 1:0.003 to about 1:0.002.

4 Claims, 2 Drawing Sheets

× 170

× 170

× 250

× 170

METHOD OF FORMING AND COMBUSTING WATER-IN-FUEL OIL EMULSION

BACKGROUND OF THE INVENTION

1. Field of the Invention

This invention relates to an emulsified fuel oil, an additive for emulsifying a fuel oil with water, and methods of making and using the same.

2. Description of Related Art

Heavy oil is produced in a final stage of oil refining process and generally divided into three different classes, that is, heavy oil type A, heavy oil type B and heavy oil type C in accordance with their viscosity. Since heavy oil generates high calory (more than 10,000 Kcal/Kg) and is relatively inexpensive and easy to handle, it is estimated that the commercial consumption of heavy oil accounts for nearly 70%–80% of all oil products which are used in Japan for facilities in various industries including large scale heating facilities and large vessels.

When heavy oil, in particular high viscosity heavy oil such as heavy oil B and heavy oil C, is burnt, a large volume of pollutants, such as, sulphur oxide, nitrogen oxide, carbon monoxide, soot and dust is generated. If no effective antipollution countermeasure is taken, these pollutants can contaminate the environment and pose a serious threat to the ecological system. The Japanese government sets various standards regarding the maximum permissible discharge levels of toxic pollutants for facilities which burn heavy oil. The Japanese government imposes on the industries strict preventive measures to keep the discharge level below the standard level. As a result, the industries in which heavy oil is used as a fuel generally tend to make substantially large investments to equip heavy oil burning facilities with highly complex and expensive antipollution devices and facilities.

However, these antipollution devices and facilities tend to become more complex and expensive, particularly when lower grade oil, such as heavy oil C, is used. Major electric companies, for example, use heavy oil C because heavy oil C is relatively inexpensive as compared with heavy oil A and B, although heavy oil C generates more pollutants. In order to comply with the government antipollution standard and regulation, these electric companies have to make substantial investments in antipollution facilities or, alternatively, mix heavy oil C with heavy oil A or heavy oil B in order to reduce emission of pollutants, resulting in a substantial increase in cost. Furthermore, a perfect combustion of heavy oil B and heavy oil C is relatively difficult unless they are sprayed into substantially small particles.

It is appreciated that, when heavy oil is used for the operation of a boiler, heavy oil is sprayed by a jet injector to form a jet stream of very fine particles in order to achieve a satisfactory combustion. However, the jet stream itself tends to disrupt the combustion of the particles of heavy oil. This will lower the thermal efficiency of the boiler. In order to improve the thermal efficiency, the air/oil ratio may be adjusted. However, such an adjustment of air/oil ratio tends to enlarge the size of oil particles, and results in imperfect combustion of heavy oil and thus higher emission of pollutants.

Waste oil may be burnt for treatment. In facilities where waste oil is generated as a result of routine operation, such as, waste machine oil at a garage or a factory, waste machine oil may be separated into a reusable part, a non-reusable part, water, etc. In accordance with the Japanese government antipollution regulations, the non-reusable oil must be completely burnt in an incinerator while controlling the emission of pollutants below the strict discharge levels set by the government. Water may be separated by using a waste oil purification separator tank or by natural separation of water from oil during storage. While the separated water generally does not appear to contain any waste oil, the water is contaminated with the waste oil and has offensive smell. Therefore, the separated water must be thoroughly filtered and purified to completely remove oil content therefrom before the water is discharged. If this separated water is discharged into a river or a lake without a proper filtration or a purification treatment, the river or the lake will be contaminated. To filter and purify the separated water, a water filtration and purification facility is required, in addition to the waste oil treatment facilities.

SUMMARY OF THE INVENTION

It is an object of embodiments of the present invention to reduce the emission of pollutants generated by the combustion of heavy oil and waste oil.

It is a further object of embodiments of the present invention to provide a fuel oil product with low emission of pollutants.

It is still a further object of embodiments of the present invention to provide a heavy oil product with a higher combustion efficiency and a lower emission of pollutants.

It is yet another object of the present invention to provide an emulsified oil product in which disperse phases of water are substantially uniformly distributed in a dispersion medium of oil.

These and other objects and advantages are achieved, in accordance with one embodiment of the present invention, in an emulsifying additive for emulsifying a fuel oil with water in which disperse phases of water are generally uniformly distributed in a dispersion medium of fuel oil. When the emulsified fuel oil is sprayed by a burner injector for the operation of a boiler or other fuel oil facilities, the emulsified fuel oil is sprayed into numerous droplets or particles. As a result, it has been recognized that the particles comprise cores of water encapsulated in fuel oil (water-in-oil capsularized emulsion particle fuel). As will be described later in greater detail, the water-in-oil capsularized emulsion particle fuel substantially improves the thermal efficiency of boiler facilities and reduces the generation of pollutants and maintenance expenses for maintaining the facilities.

DETAIL DESCRIPTION OF PREFERRED EMBODIMENTS

Figure 1:
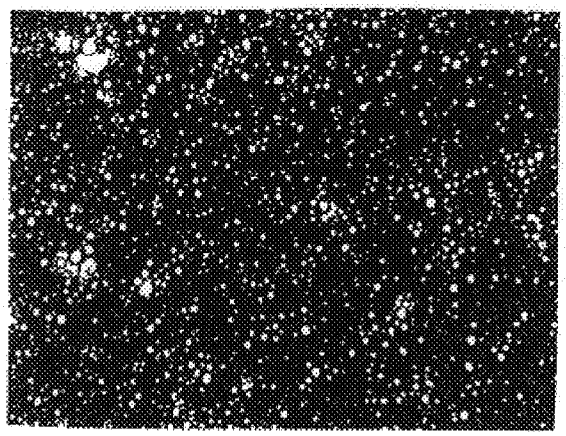
FIG. 1 is a microscopic photograph (170 times magnified) of a water-in-heavy oil emulsion which is obtained by the use of an emulsifying additive solution in accordance with one embodiment of the present invention.

In accordance with embodiments of the present invention, an emulsifying additive solution emulsifies an oil with water to form a water-in-oil emulsion. As described below in greater detail, the water-in-oil emulsion is essentially formed by disperse phases of water which are generally uniformly distributed and suspended in a dispersion medium of oil. In other words, particles of water are generally uniformly distributed and suspended in the body of oil in the water-in-oil emulsion. It is observed that, in the water-in-oil emulsion, each of the water particles is enclosed or encapsulated in oil, and that the water particles are separated from each other by oil. A variety of different types of oil have been examined. It has been recognized that an emulsifying additive in accordance with embodiments of the present invention effectively emulsifies, for example, a heavy oil (e.g. heavy oil A, B and C), motor oil which is used for lubrication of automobile engines, edible oil and other machine oil.

In accordance with one embodiment of the present invention, caustic soda (NaOH), calcium chloride ($CaCl_2$) and water are mixed together to form an emulsifying additive solution. It is noted that caustic soda (NaOH) and calcium chloride ($CaCl_2$) may be premixed prior to mixing with water, or all of the three may be mixed together at once. In one embodiment, substantially the same amount of caustic soda (NaOH) and calcium chloride ($CaCl_2$) are mixed with water.

A variety of mixing ratios between caustic soda (NaOH) and calcium chloride ($CaCl_2$) and water have been examined to verify the effectiveness of the emulsifying additive solution. Caustic soda (NaOH) and calcium chloride ($CaCl_2$) and water are mixed together in a weight ratio ranging between about 10:10:100 and about 50:50:100 (e.g., 10 Kg:10 Kg:100 Kg and 50 Kg:50 Kg:100 Kg) to form an emulsifying additive solution. These mixing ratios have been found to provide effective emulsifying additive solutions.

In preferred embodiments, caustic soda (NaOH) and calcium chloride ($CaCl_2$) and water are mixed together in a weight ratio ranging between about 15:15:100 and about 35:35:100 (e.g., 15 Kg:15 Kg:100 Kg and 35 Kg:35 Kg:100 Kg). It is recognized that these mixing ratios provide optimum emulsifying additive solutions in view of both the economy and efficiency. In a preferred embodiment, about 20 Kg of caustic soda (NaOH), about 20 Kg of calcium chloride ($CaCl_2$) and about 100 liter of water are thoroughly mixed at room temperature to form an emulsifying additive solution (Additive No. 1). Also, a mixing ratio of about 30 Kg of caustic soda (NaOH), 30 Kg of calcium chloride ($CaCl_2$) and 100 liter of water, and a mixing ratio of about 25 Kg of caustic soda (NaOH) and 25 Kg of calcium chloride ($CaCl_2$) each provides substantially the same result in the emulsification of a heavy oil with water as obtained by the mixing ratio of 20 Kg of caustic soda (NaOH), 20 Kg of calcium chloride ($CaCl_2$) and 100 liter of water.

An emulsifying additive solution in accordance with an embodiment of the present invention is thoroughly mixed with oil and water to form a water-in-oil emulsion in which disperse phases of water are substantially uniformly distributed and suspended in a dispersion medium of oil. An emulsifying additive solution can be mixed with water and oil in a wide range of mixing ratios for effective emulsification of oil and water. According to tests carried out by the inventor, the emulsifying additive solution No. 1 efficiently emulsifies a mixture of water and oil having a mixing ratio ranging between about 5:95 and 30:70 (e.g., 5 Kg:95 Kg and 30 Kg:70 Kg).

In one embodiment, water and heavy oil type C are mixed in a mixing ratio ranging between about 70:30 and 75:25 (e.g., 70 Kg:30 Kg and 75 Kg:25 Kg) for an optimum combustion efficiency. In tests, the emulsifying additive solution No. 1 and mixture of water and oil were mixed in a mixing ratio ranging from about 0.002:1 to about 0.003:1 (e.g., 0.2 Kg of the emulsifying additive solution: 100 Kg of the mixture of water and oil and 0.3 Kg:100 Kg). These mixing ratios resulted in good emulsification of water and oil.

In a further embodiment, the emulsifying additive solution No. 1 and the mixture of water and oil was mixed in a mixing ratio at about 0.001:1 (e.g., 0.1 Kg:100 Kg). This mixing ratio generally resulted in good but minimum emulsification efficiency. In another embodiment, the emulsifying additive solution No. 1 and the mixture of water and oil was mixed in a mixing ratio at about 0.1:1 (e.g., 1 Kg:100 Kg).

It is observed that the efficiency in emulsification reaches an optimum level about this mixing ratio. It is also observed that the efficiency in emulsification does not substantially change if the amount of the emulsifying additive solution is increased further than this mixing ratio with respect to the amount of the mixture of water and oil. Thus, preferred embodiments have a mixing ratio between the emulsifying additive solution No. 1 and the mixture of water and oil at least 0.1:1.

Figure 2:
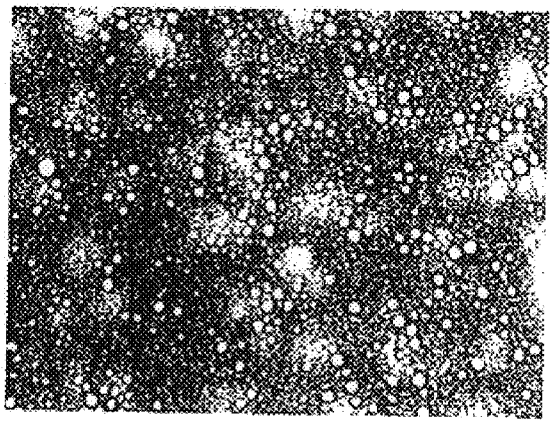
FIG. 2 is a microscopic photograph (250 times magnified) of a water-in-oil emulsion which is obtained by the use of an emulsifying additive solution in accordance with one embodiment of the present invention.

In one embodiment, heavy oil type C, water and Additive No. 1 in a weight ratio of 50:50:0.3 (e.g., 50 g:50 g:0.3 g) were thoroughly and vigorously mixed until the mixture becomes an emulsion. The emulsion was stored at room temperature (about 25 degree Centigrade) for 7 days. Photographs of FIG. 1 and FIG. 2 were taken 7 days after the emulsion was made. As shown in the photographs of FIGS. 1 and 2, particles of water (white dots) are generally uniformly distributed and suspended in the heavy oil C (water-in-oil emulsion).

In a test to verify the magnitude of separation between water content and oil content, a specimen (100 ml) of the emulsion was heated to 60 degree Centigrade and subjected to a centrifugal separator for 20 minutes at a relative centrifugal force of 600. It was observed that substantially no separation of water content from the oil content occurred. It was observed that, even after 40 days, the emulsion was stable, and the water content and oil content did not separate from each other.

In another embodiment, heavy oil C, water and Additive No. 1 in a weight ratio of 30:70:0.3 were thoroughly and vigorously mixed until the mixture becomes an emulsion. It was also observed that substantially no separation of water content from the oil content occurred. The emulsion at this mixing ratio has a volume resistivity of about $4.1\times10^9$. It is observed that the volume resistivity does not change for a long time. This also shows that the water-in-oil emulsion fuel made in accordance with embodiments of the present invention is very stable and therefore can be stored for a long time. As a result, the water-in-oil emulsion fuel made in accordance with embodiments of the present invention can be used immediately after storage of the emulsion fuel for a substantial period of time without an extra mixing operation for re-emulsification.

Figure 3:
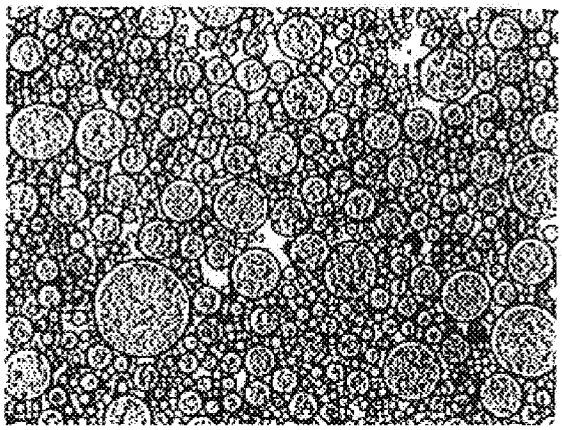
FIG. 3 is a microscopic photograph (170 times magnified) of an oil-in-water emulsion which is obtained by the use of a conventional emulsifying additive.

In contrast, when heavy oil type C, water and a conventional emulsifying agent (a surface active agent) in a weight ratio of 50:50:2.5 (e.g., 50 g:50 g:2.5 g) are mixed until the mixture becomes an emulsion, particles of heavy oil type C (circular dots in various sizes) are suspended in water (oil-in-water emulsion), as shown in a photograph of FIG. 3. It is observed that the oil-in-water emulsion made by typical conventional emulsifying agent is not stable. The oil content and the water content of the oil-in-water emulsion generally start separating from each other in several days after the oil-in-water emulsion is formed.

In the above embodiments, caustic soda (NaOH) and calcium chloride ($CaCl_2$) and water are first mixed to form an emulsifying additive solution, and the emulsifying additive solution is added to oil and water only when an emulsion of the oil and water is to be made. Caustic soda (NaOH) and calcium chloride ($CaCl_2$) may be directly added in water and oil when the water and oil are mixed. However, it is observed that if caustic soda (NaOH) and calcium chloride ($CaCl_2$) are directly added in water and oil when an emulsion is made, a substantially larger amount of both caustic soda (NaOH) and calcium chloride ($CaCl_2$) is required as compared with the amount of the emulsifying additive solution which is required to achieve a similar result of emulsification.

Figure 4:
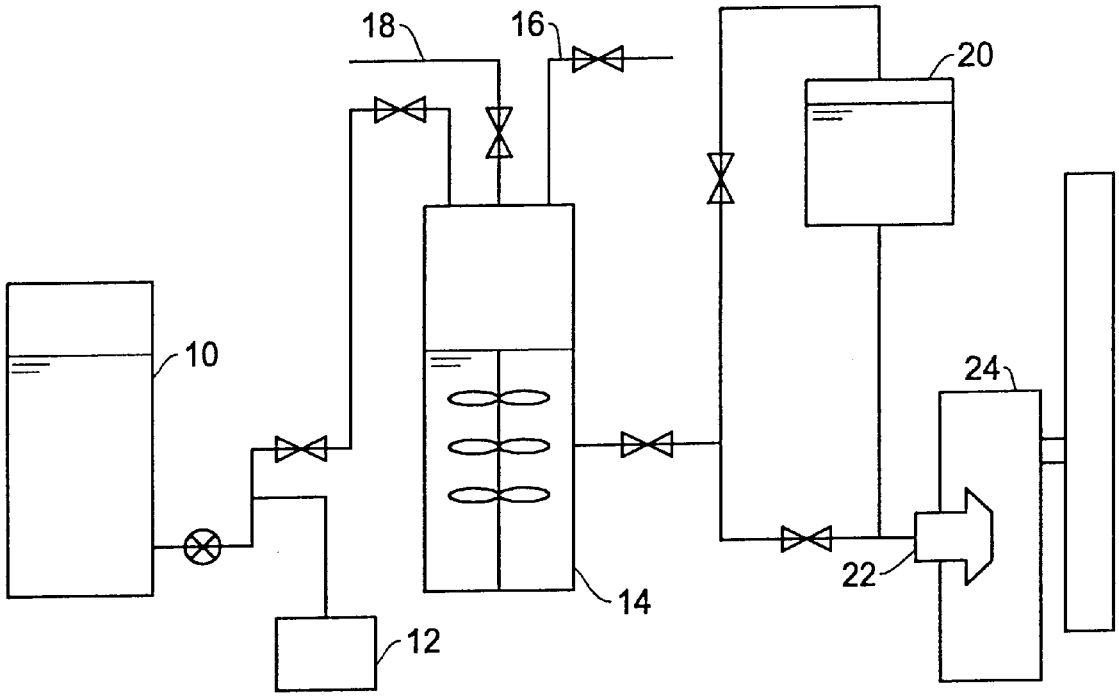
FIG. 4 schematically shows a layout of one embodiment of an emulsified fuel storage and supply system which supplies an emulsion fuel to a boiler facility.

FIG. 4 schematically shows a layout of one embodiment of an emulsified fuel storage and supply system which supplies an emulsion fuel to a boiler facility. A storage tank 10 stores a fuel oil, such as for example, heavy oil B, C or a mixture thereof. The fuel oil stored in the storage tank 10 is pumped out by an oil pump 12 and conveyed to a mixer 14. At the mixer 14, the fuel oil is mixed with water supplied through a water supply line 16 and an emulsifying additive solution supplied through an emulsifying additive solution supply line 18.

The mixture of the fuel oil, water and emulsifying additive solution are thoroughly mixed until the mixture becomes an emulsion. The emulsion may be conveyed to an emulsion fuel storage tank 20 for storage or directly conveyed to a burner 22 for the operation of a boiler 24. Since the emulsion fuel made in accordance with embodiments of the present invention is stable, and the fuel oil content in the emulsion fuel does not separate from the water content, the emulsion fuel can be stored in the fuel storage tank 20 for a relatively long time.

A complete combustion of heavy oil type B and type C is relatively difficult unless they are sprayed into particles of substantially small diameter. Minute particles of heavy oil type C, for example, may completely evaporate and achieves a complete combustion. In contrast, when the size of particles of heavy oil type C is relatively large, the central portion of each particle does not completely evaporate even though the surface portion achieves a complete evaporation. Rather, the heat at the surface portion tends to solidify the central portion of the particle. This will cause a higher emission of pollutants.

In one aspect, an emulsifying additive solution in accordance with embodiments of the present invention provides a water-in-oil emulsion fuel in which disperse phases of water are distributed in a dispersion medium of oil. The water-in-oil emulsion fuel is sprayed into minute particles, for example by a burner injectable provided in a boiler in the operation of a boiler, the particles have cores of water, in other words, cores of water are encapsulated in heavy oil (encapsulated emulsion oil particles).

Therefore when the particles burn, the capsule portion of oil first evaporates and burns while the heat of the burning capsule portion of oil heats up the core of water. Before the capsule portion completely evaporates, the water at the core explosively evaporates and ruptures the shell of oil which sprays the oil content into much smaller particles. As a result, a complete combustion is achieved. In general, in the operation of a boiler facility, the use of a water-in-oil emulsion fuel oil (water and heavy oil B or C) reduces air requirement for a complete combustion, improves the thermal efficiency of the boiler facility and reduces the generation and deposit of carbon and ash on the boiler interior walls.

The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. A method of forming and combusting fuel emulsion comprising the steps of:

mixing NaOH, $CaCl_2$ and water to form an emulsifying additive solution in a weight ratio ranging from about 10:10:100 to about 50:50:100;

adding the emulsifying additive solution to a mixture of fuel oil and water;

mixing the emulsifying additive solution and the mixture of fuel oil and water to form water-in-fuel oil emulsion having a dispersion medium of fuel oil and disperse phase of water uniformly distributed and suspended in the dispersion medium of oil; and spraying the water-in-fuel oil emulsion over a burner in a form of particles so that each of the particles having a core of water encapsulated by fuel oil is exploded by heat produced by combustion of the fuel oil.

2. A method as defined in claim 1, wherein the NaOH, $CaCl_2$ and water of the emulsifying additives solution are mixed together in said mixing step in a weight ratio ranging from about 15:15:100 to about 35:35:100.

3. A method as defined in claim 1, wherein the NaOH, $CaCl_2$ and water of the emulsifying additives solution are mixed together in said mixing step in a weight ratio ranging from about 15:15:100 to about 25:25:100.

4. A method as defined in claim 1, wherein the NaOH, $CaCl_2$ and water of the emulsifying additive solution are mixed together in said mixing step in a weight ratio of about 20:20:100.

* * * * *